US006347906B2

(12) United States Patent
Schuler

(10) Patent No.: US 6,347,906 B2
(45) Date of Patent: Feb. 19, 2002

(54) MARKING ELEMENT

(75) Inventor: Gerhard Schuler, Wattens (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 09/270,011

(22) Filed: Mar. 16, 1999

(30) Foreign Application Priority Data

Jul. 21, 1998 (AT) ..... 498/98 U

(51) Int. Cl.[7] ..... E01F 9/06
(52) U.S. Cl. ..... 404/16; 404/14
(58) Field of Search ..... 404/9, 12, 14, 404/15, 16

(56) References Cited

U.S. PATENT DOCUMENTS

| | | | | |
|---|---|---|---|---|
| 2,304,345 A | * | 12/1942 | Elliott | 404/15 |
| 3,409,344 A | | 11/1968 | Balint et al. | |
| 3,485,148 A | * | 12/1969 | Heenan | 404/14 |
| 3,971,623 A | * | 7/1976 | Hedgewick et al. | 404/12 |
| 3,975,108 A | | 8/1976 | Suhr et al | 404/16 |
| 3,984,175 A | | 10/1976 | Suhr et al. | |
| 4,232,979 A | * | 11/1980 | Johnson, Jr. et al. | 404/16 |
| 4,428,320 A | * | 1/1984 | Oplt et al. | 116/63 R |
| 4,498,733 A | | 2/1985 | Flanagan | |
| 4,955,982 A | * | 9/1990 | Paulos | 404/11 |
| 5,240,344 A | * | 8/1993 | Green | 404/14 |
| 5,277,513 A | | 1/1994 | Flanagan et al. | |
| 5,340,231 A | * | 8/1994 | Steere et al. | 404/14 |
| 5,393,166 A | * | 2/1995 | Stock et al. | 404/14 |
| 5,470,170 A | * | 11/1995 | Lindner | 404/9 |
| 5,502,593 A | | 3/1996 | Hedgewick | |
| 5,667,334 A | * | 9/1997 | Boyce | 404/9 |
| 5,667,335 A | * | 9/1997 | Khieu et al. | 404/14 |
| 5,816,737 A | * | 10/1998 | Siblik | 404/13 |
| 5,927,897 A | * | 7/1999 | Attar | 404/12 |

FOREIGN PATENT DOCUMENTS

| | | |
|---|---|---|
| DE | 41 12 702 | 10/1992 |
| FR | 2 504 568 | 10/1982 |
| GB | 2 086 454 | 5/1982 |
| GB | 2 276 583 | 10/1994 |
| WO | 91/11560 | 8/1991 |
| WO | 96/29471 | 9/1996 |

* cited by examiner

*Primary Examiner*—Thomas B. Will
*Assistant Examiner*—Kristine Markovich
(74) *Attorney, Agent, or Firm*—Wenderoth, Lind & Ponack, L.L.P.

(57) ABSTRACT

An approximately cuboidal or frustopyramidal, partially hollow marking element has a flat bottom plate and a main body which is stiffened by ribs and which is connected at two mutually opposite sides to preferably reflecting bars. The marking element comprises only the bars and the main body which is integral with the bottom plate and in the interior of which a plurality of ribs extend normal to the bars. At most one rib extends parallel to the bars.

8 Claims, 1 Drawing Sheet

MARKING ELEMENT

BACKGROUND OF THE INVENTION

The invention relates to an approximately cuboidal or frustopyramidal, partially hollow marking or signaling element provided with a flat bottom plate, with a main body which is stiffened by ribs and which is preferably connected at two mutually opposite sides to reflecting bars.

A marking element of that kind is known from U.S. Pat. No. 4,340,419. By virtue of the bottom plate provided in that arrangement, it is relatively simple to stick it to a carriageway while the ribs on the main body afford the main body the necessary strength for it to be run over by vehicles. A disadvantage with such known arrangement however is that both the bottom plate and two non-reflecting side walls form separate parts which each have to be connected to the main body.

The applicants on the other hand have already marketed a marking element which only comprises a main body injection-molded from plastic material and two reflecting bars or strips connected thereto. Stiffening ribs form a closed grid, which means that the molding can only be removed from the mold in a downward direction so that the marking element has a plurality of downwardly open cavities and only the free ends of the ribs can be glued to a carriageway.

SUMMARY OF THE INVENTION

The object of the present invention is so to provide a marking element of the above type,that, while maintaining its static properties, can be easily manufactured. Such object is attained in that the marking element only comprises bars and a main body or base body which is integral with the bottom plate and in the interior of which a plurality of ribs extend normal to the bars, but on the other hand at most one rib extends parallel to the bars.

The main body according to the invention forms a tube whose open ends are closable by the reflecting bars. As the ribs in the interior of the tube extends in the longitudinal direction thereof, the main body can be easily removed from an injection-molding tool after production thereof in the injection-molding tool, as it is only necessary to provide a mold core which extends parallel to the tube and which finally has to be pulled out. If two such mold cores are provided, then a rib extending parallel to the reflecting bars can be arranged in the middle of the hollow body so that the ribs cross at the center of the marking element and the central region becomes particularly strong and stable.

BRIEF DESCRIPTION OF THE DRAWINGS

Further details of the invention are described hereinafter with reference to the drawings in which.

DETAILED DESCRIPTION OF THE INVENTION

Figure 2:
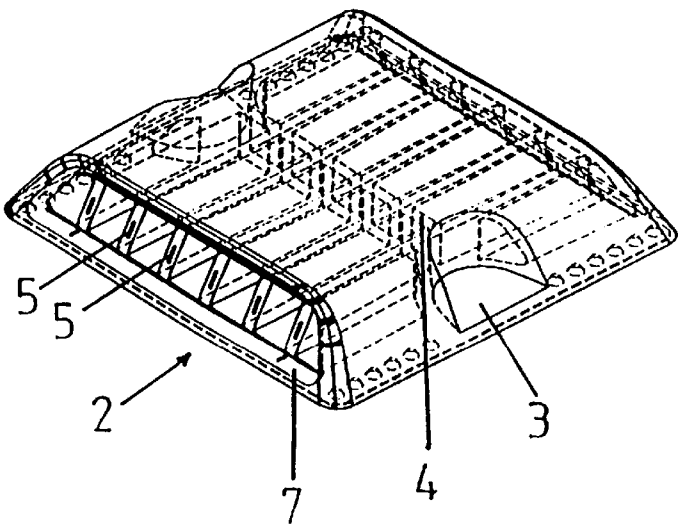
FIG. 2 is a view of the same main body viewing transparently therethrough and as seen obliquely from above.
Figure 1:
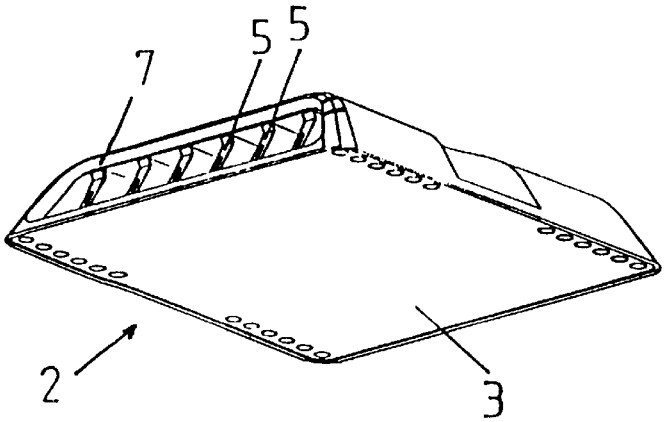
FIG. 1 is a diagrammatic view of a main body of a marking element as seen obliquely from below.

A main body or base body 2 for a marking or signaling element, as shown in FIG. 1, is an integrally produced molding of plastic material. It is of a symmetrical configuration relative to a longitudinal and transverse central plane and has open edges 7 at two mutually opposite ends. Six stiffening or main ribs 5 extend in the longitudinal direction of the main body 2, which has a bottom plate 3.

By virtue of the fact that the marking element is of a symmetrical structure and the ribs 5 extend in the longitudinal direction, a mold core which, in an injection-molding procedure, fills the intermediate spaces between the ribs 5 can be easily removed. If two mold cores which can be pulled in opposite directions are used, it is possible to provide in the central region of the marking element a secondary rib 4 which extends substantially normal to the ribs 5.

Figure 4:
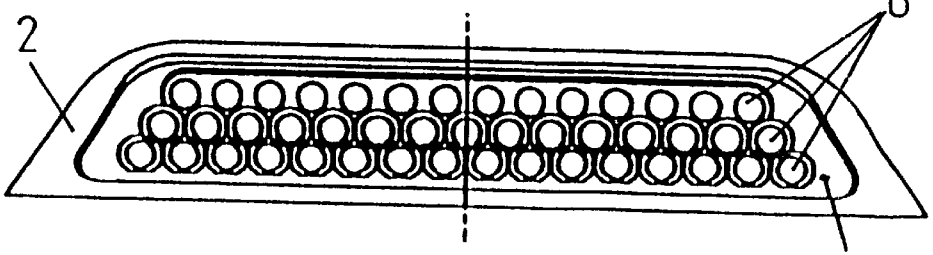
FIG. 4 is a view of a finished marking element as seen from the left in relation to FIG. 3.
Figure 3:
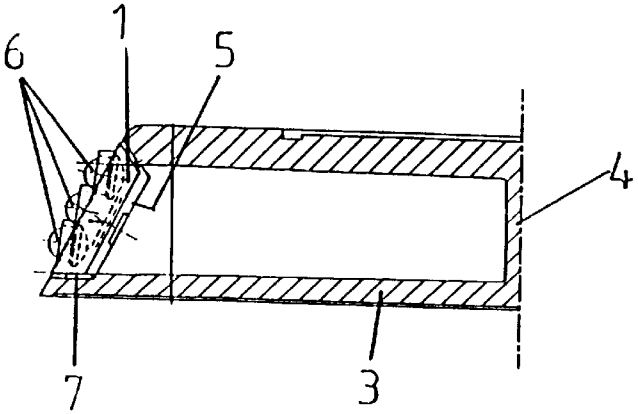
FIG. 3 is a view in section parallel to two ribs in FIGS. 1 and 2 with inserted reflecting bar.

As can be seen from FIG. 3, reflecting strips or bars 1 can be fitted into the main body 2. In the illustrated case, they comprise plastic material and carry glass reflector elements 6. The bars 1 are fitted on both sides of the main body 2 in a slightly inclined position into the open ends of the main body 2 and are welded to the respective edges 7 by means of ultrasound. Viewed from the left in relation to FIG. 3, that thus gives the view shown in FIG. 4 of the finished marking element.

Instead of consisting of plastic material the marking element could be made from metal, preferably by means of aluminum die casting. One or even both reflecting bars 1 could be replace by dummy bars.

What is claimed is:

1. An approximately cuboidal or frustopyramidal, partially hollow marking element comprising:

a bottom plate;

a main body having a longitudinal axis and being joined to said bottom plate to form a single element having opposite open ends with respect to said longitudinal axis;

reflective strips secured to said main body at said ends of said single element;

main ribs within said main body and extending in a direction between said open ends; and a single secondary rib within said main body, said secondary rib extending approximately normal to said main ribs, wherein said bottom plate, said main body, said main ribs and said secondary rib together form a unitary, one-piece structure.

2. An element as claimed in claim 1, wherein said main body is formed of plastic.

3. An element as claimed in claim 1, wherein said main body is formed of aluminum.

4. An element as claimed in claim 1, wherein said reflective strips are formed of plastic.

5. An element as claimed in claim 1, wherein said reflective strips are formed of glass.

6. An element as claimed in claim 1, wherein said main body has a structure resulting from production of said main body in an injection-molding tool with two mold cores engaging between areas in which are to be formed said main ribs and which can be pulled in opposite directions.

7. An element as claimed in claim 6, wherein said main body is connected to said bottom plate by ultrasonic welding.

8. An element as claimed in claim 1, wherein said main body is connected to said bottom plate by ultrasonic welding.

* * * * *